United States Patent [19]

Weeks

[11] Patent Number: 4,496,000

[45] Date of Patent: Jan. 29, 1985

[54] METHOD OF AND APPARATUS FOR SETTING A MECHANICAL LINER HANGER BY RIGHT-HAND ROTATION

[75] Inventor: Benjamin R. Weeks, Corpus Christi, Tex.

[73] Assignee: Texas Independent Tools and Unlimited Service, Inc., Corpus Christi, Tex.

[21] Appl. No.: 465,738

[22] Filed: Feb. 11, 1983

[51] Int. Cl.[3] ..... E21B 23/00

[52] U.S. Cl. ..... 166/382; 166/208; 166/216; 166/217

[58] Field of Search ..... 166/382, 381, 208, 210, 166/211, 213, 216, 217, 206, 138, 139, 134, 331, 240, 117.7

[56] References Cited

U.S. PATENT DOCUMENTS

| | | | |
|---|---|---|---|
| 1,248,881 | 12/1917 | Mack | 166/138 |
| 1,892,442 | 12/1932 | Wickersham | 166/216 |
| 2,106,859 | 2/1938 | Spang | 166/138 |
| 2,156,939 | 5/1939 | Fulkerson | 166/208 |
| 2,162,179 | 6/1939 | Mueller | 166/382 |
| 2,772,740 | 12/1956 | Edwards | 166/216 |
| 3,191,684 | 6/1965 | Pittman et al. | 166/216 |
| 3,338,308 | 8/1967 | Elliston et al. | 166/138 |
| 3,433,303 | 3/1969 | Clark, Jr. et al. | 166/240 |
| 3,467,184 | 9/1969 | Young | 166/138 |

*Primary Examiner*—James A. Leppink
*Assistant Examiner*—Hoang C. Dang
*Attorney, Agent, or Firm*—Fulbright & Jaworski

[57] ABSTRACT

A method of and apparatus for setting a mechanical liner hanger inside of a well conduit by right-hand or clockwise rotation and without downward movement. The hanger includes a mandrel having an annular cone and a lug. A movable cage telescopically and rotatably mounted on the mandrel includes slips, bow springs and a right-hand downwardly extending and downwardly directed spiral surface. A hanger is moved downhole with the lug engaging the cage holding the slips in the retracted position. When the setting location is reached the mandrel is lifted up releasing the cage, and the mandrel is rotated by right-hand rotation moving the lug against the downwardly directed surface of the cage for moving the slips upwardly onto the cone and expanding the slip into a setting engagement with the well conduit. The set hanger may be released by longitudinally raising the mandrel and lug. The liner hanger may be recocked by engaging the downwardly directed surface of the cage with the lug and raising the lug to rotate the cage into a recocking position.

6 Claims, 4 Drawing Figures

Fig. 2
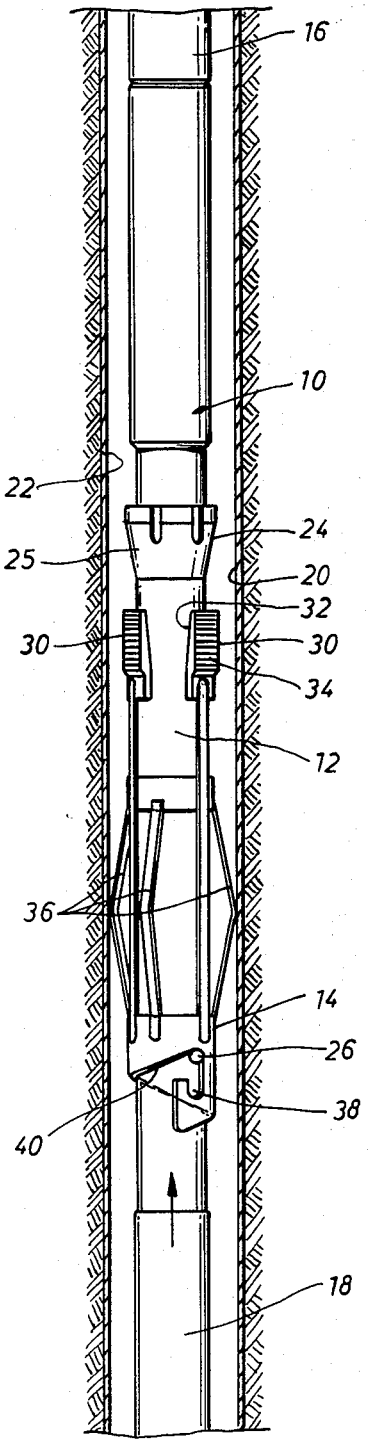
Fig. 3
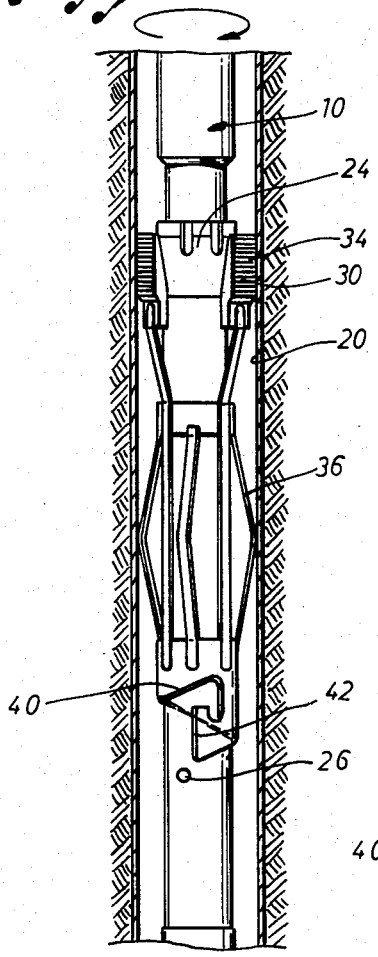
Fig. 1
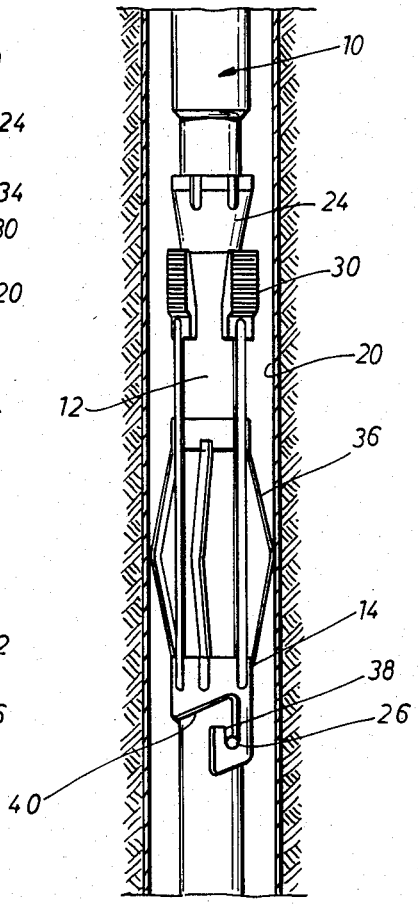
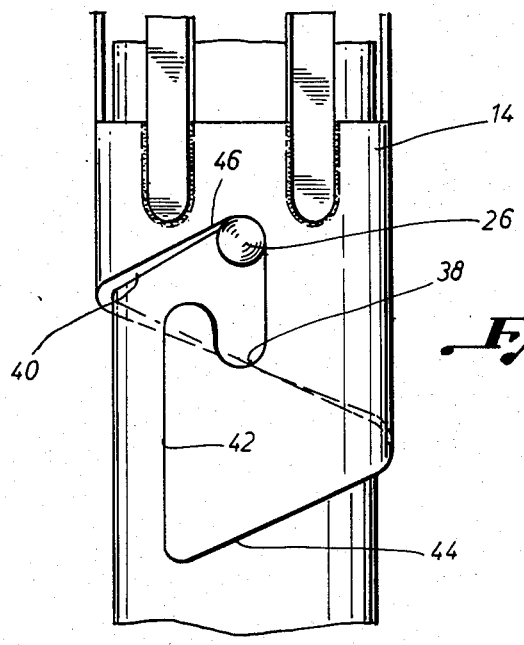
Fig. 4

METHOD OF AND APPARATUS FOR SETTING A MECHANICAL LINER HANGER BY RIGHT-HAND ROTATION

BACKGROUND OF THE INVENTION

Liner hangers are used to be attached to the upper end of a liner and are then set to grip the inside surface of the casing for hanging the liner in the casing. The liner hangers are usually set by actuating slips relative to a cone which grip the inside of the casing for hanging a liner.

The present invention is directed to a method and apparatus of setting a mechanical liner hanger inside of a well conduit by right-hand or clockwise rotation and in which the liner may be easily released and/or recocked and reset to a different location.

SUMMARY

The present invention is directed to a right-hand set mechanical liner hanger for engaging the inside of a well conduit. The hanger includes a mandrel having an annular wedge shaped cone around the outer circumference of the mandrel with a lug connected to the outside of a mandrel below the cone. A cage is telescopically and rotatably movable on the mandrel between the cone and the lug. The cage includes (1) a plurality of slips extending upwardly and adapted to move upwardly onto the cone and outwardly to a set position for engaging a well conduit, (2) a plurality of bow springs extending outwardly for engaging a well conduit for allowing longitudinal and rotational movement of the cage relative to the mandrel, (3) an upwardly directed opening for engagement by the lug whereby the cage can be moved downwardly in a well conduit with the mandrel while preventing the slips from setting, and (4) a clockwise, downwardly extending and downwardly directed surface extending from above the opening to past the bottom of the opening whereby an upward movement of the mandrel will move the lug out of the opening onto the downwardly directed surface and right-hand rotation of the mandrel will move the slips upwardly onto the cone for setting.

A still further object of the present invention is wherein the rotational extent of the downwardly directed spiral surface is greater than 360° and the vertical extent of the surface is great enough to provide for the movement of the slips onto the cone. Preferably the downwardly directed surface is helically contoured at an angle of approximately fifteen degrees. A vertical passageway extends from the lower end of the downwardly directed surface to the upper part of the downwardly directed surface for allowing the mandrel to be released and/or recocked.

Yet a still further object of the present invention is the provision of the method of setting a mechanical liner hanger in a well conduit in which the hanger includes a mandrel having an annular cone and a lug with a movable cage therebetween which includes slips, bow springs and a right-hand downwardly extending and directed surface. The method comprehends moving the hanger down a well conduit while holding the cage with the lug for preventing the slips from moving onto the cone. When the setting location is reached, lifting up the mandrel and releasing the cage for upward movement. And thereafter rotating the lug by right-hand rotation against the surface of the cage thereby moving the cage and the slips upwardly onto the cone and expanding the slips into a setting engagement with the well conduit. The setting operation is performed without downward movement of the cone relative to the slips.

The method of the present invention further comprehends, after setting the liner hanger, releasing the liner hanger by longitudinally raising the mandrel and lug. The method also includes recocking the released liner hanger by engaging the downwardly directed surface of the cage with the lug and raising the lug to rotate the cage into a recocking position.

Other and further objects, features and advantages will be apparent from the following description of a presently preferred embodiment of the invention, given for the purpose of disclosure and taken in conjunction with the accompanying drawings.

BRIEF DESCRIPTION OF THE DRAWINGS

FIG. 1 is a fragmentary elevational view illustrating the liner hanger of the present invention in a well casing for movement downhole, FIG. 2 is an elevational view of the liner hanger of FIG. 1 in an intermediate position, FIG. 3 is an elevational view of the liner hanger of the present invention in a set position in a well casing, and FIG. 4 is an enlarged fragmentary elevational view illustrating the configuration of a portion of the cage.

DESCRIPTION OF THE PREFERRED EMBODIMENT

Referring now to the drawings, the reference numeral 10 generally indicates the right-hand set mechanical liner hanger of the present invention and generally includes a mandrel 12 and a cage assembly 14.

The mandrel 12 generally includes threaded connections at either end for connecting the hanger 10 to a conventional setting tool 16 at the top and a liner 18 at the bottom which is to be hung or supported from a well conduit such as a casing 20 positioned in a well 22. The mandrel also includes an annular wedge cone 24 which is fixedly secured to the mandrel 12 and a lug or pin 26 connected to the outside of the mandrel 12 below the cone 24.

The cage assembly 14, which is telescopically and rotationally slidable on the mandrel 12 between the cone 24 and the lug 26, includes a plurality of slips 30 having an interior wedge surface 32 and a plurality of horizontally extending teeth 34 on the outside. The slips 30 are adapted to be moved upwardly onto the wedge surface 25 of the cone 24 and outwardly into an engaging position with the interior of the casing 20 into a set position. The teeth 34 on the outside of the slips engage and grip the casing 20. The cage assembly 14 also includes a plurality of bow springs 36 which extend outwardly and engage the interior of the casing 20 for allowing longitudinal and rotational movement of the cage 14 relative to the mandrel 12.

The cage 14 includes an upwardly directed opening 38 for engagement by the lug 26, as best seen in FIGS. 1 and 4, whereby the cage 14 may be moved downwardly with the mandrel 12 inside the casing 20 while preventing the slips 30 from engaging the cone 24 and setting. The cage also includes a clockwise, downwardly extending and downwardly directed spiral surface 40 extending from above the opening 38 in a generally helical path, at an angle of approximately fifteen degrees, past the bottom of the opening 38 whereby an upward movement of the mandrel 12 will move the lug 26 out of the opening 38 and onto the downwardly directed surface 40. Thereafter a right-hand rotation of the mandrel 12 will move the cage 14 and the slips 24 upwardly. The vertical lead or extent of the downwardly directed surface 40 is sufficient so that rotation of the lug 26 and consequent upward movement of the cage 14 will move the slips 30 onto the cone 24 for setting. Preferably, the rotational extent of the downwardly directed surface 40 is greater than 360°. In addition, a passageway 42 is provided extending between the lower extent 44 of the surface 40 and the upper extent 46 of the surface 40 for allowing the hanger 10 to be released and/or recocked.

In use, the liner hanger 10 of the present invention is assembled, as shown in FIG. 1, with the lug 26 positioned in the opening 38 of the cage assembly 14. The hanger 10 is moved down the casing 20. While the bow springs 36 engage the interior of the casing 20 and attempt to move the slips 30 upwardly relative to the cone 24, the lug 26 holds the cage assembly 14 against relative movement to the mandrel 12 and prevents the setting of the slips 30 until the desired setting location is reached. When the setting location is reached, the mandrel 12 is longitudinally raised (as best seen in FIG. 2) causing the lug 26 to be released from the opening 38 and to engage the downwardly directed surface 40. The mandrel 12 is then held in the vertical position, but is rotated to the right or clockwise. The lug 26 rotates relative to the downwardly directed surface 40 causing the cage 14 to move upwardly as the bow springs 36 prevent rotation of the cage 14 but allow vertical movement of the cage 14. Therefore, rotation of the lug 46 causes the cage 14 and slips 30 to move upwardly and the slips 30 move onto the wedge surface 25 of the cone 24 causing the teeth 34 on the back side of the slips 30 to engage and bite into the interior of the casing 20, as best seen in FIG. 3. It is noted that the lead or vertical travel distance of the surface 40 is sufficient to cause the slips 30 to move from their retracted position into their vertical set position on the cone 24. It is also to be noted that in the entire setting operation, the hanger 10 has been manipulated solely by vertical or right-hand rotation as left-hand rotation is an undesirable movement in a well wherein the connected joints are made up of right-handed threads. In addition, the hanger 10 does not require downward movement of the cone 24 relative to the slips 30 as do conventional hangers which sometimes causes the hanger 10 to become stuck before setting. The slips can be tested to determine if they are in the set position by releasing the weight supporting the liner hanger 10. While the liner hanger 10 is fully set prior to the time that the lug 26 reaches the passageway 42, it is to be noted that if the mandrel 12 rotates the lug 26 past the passageway 42 that the hanger 10 will remain in the set position.

The liner hanger may be easily released by rotating it to the right sufficiently, if not already positioned, to insure that the lug 26 is into the vertical passageway 42 and thereafter lifting up the mandrel 12 and lug 26 to pull the cone 26 from between the slips 30.

The hanger 12 may be easily recocked to allow the option of moving the liner hanger to a different position in the casing 12. The hanger 12 can be recocked by picking up the running in string and mandrel 12 to release the cone 24 from the slips 30 and the force of picking up will cause the lug 26 to rotate the cage 14 thereby resetting the lug 26 back into the position shown in FIG. 2. Downward movement of the mandrel 12 and lug 26 will position the lug 26 in the opening 38 as shown in FIG. 1. The liner hanger 10 may then be moved to a new location and set in the same manner.

The method of setting the mechanical liner hanger 10 in a well conduit 20 is apparent from the foregoing description of the structure and operation of the apparatus. The method however comprehends, while moving the hanger 10 down a well conduit 20, holding the cage 14 with the lug 26 whereby the slips 30 cannot move onto the cone 24, and when the setting location is reached, lifting up the mandrel 12 and releasing the cage 14 for upward movement, and thereafter rotating the mandrel 12 and lug 26 by right-hand rotation against the downwardly directed surface 40 of the cage and moving the slips 30 upwardly onto the cone 24 and expanding the slips 30 into a setting engagement with the well conduit 20.

The method further comprehends, after setting the liner hanger 10, releasing the liner hanger by longitudinally raising the mandrel 12 and lug 26. The method further comprehends recocking the released liner hanger by engaging the downwardly directed surface 40 of the cage 14 with the lug 26 and raising the lug to force rotation of the cage 14 and reposition lug 26 in the opening 38 in its run-in position shown in FIG. 1.

The present invention, therefore, is well adapted to carry out the objects and attain the ends and advantages mentioned as well as others inherent therein. While a presently preferred embodiment of the invention is given for the purpose of disclosure, numerous changes in the details of construction and arrangement of parts will readily suggest themselves to those skilled in the art and which are encompassed within the spirit of the invention and the scope of the appended claims.

What is claimed is:

1. A right-hand set mechanical liner hanger for engaging the inside of a well conduit comprising, a mandrel having an annular wedge cone around the outer circumference of the mandrel, a lug connected to the outside of the mandrel below the cone, a cage telescopically and rotationally movable on the mandrel between the cone and said lug, said cage including, a plurality of slips extending upwardly adapted to move upwardly onto the cone and outwardly to a set position for engaging a well conduit, a plurality of bow springs extending outwardly for engaging a well conduit for allowing longitudinal and rotational movement of the cage relative to the mandrel, said cage including an upwardly directed opening for engagement by the lug whereby the cage can be moved downwardly in a well conduit with the mandrel while preventing the slips from setting, said cage including a clockwise downwardly extending and downwardly directed spiral surface extending from above the opening to past the bottom of the opening whereby an upward movement of the mandrel will move the lug out of the opening onto the downwardly directed surface and right-hand rotation of the mandrel will move the slips upwardly onto the cone for setting, the rotational extent of the downwardly directed surface is greater than 360 degrees, and a vertical passageway in the cage for said lug extending between the upper and lower extents of said downwardly directed surface.

2. The apparatus of claim 1 wherein the downward angle of the spiral surface is approximately fifteen degrees.

3. The method of setting a mechanical liner hanger in a well conduit in which the hanger includes a mandrel having an annular cone and a lug with a movable cage therebetween having slips, bow springs and a right-hand downwardly extending and directed spiral surface comprising, while moving the hanger down a well conduit holding the cage with the lug whereby the slips cannot move onto the cone, when the setting location is reached, lifting up the mandrel and releasing the cage for upward movement, and rotating the lug by right-hand rotation against the downwardly directed surface of the cage and moving the slips upwardly onto the cone and expanding the slips into a setting engagement with the well conduit without moving the mandrel and cone downwardly relative to the slips.

4. The method of claim 3 wherein the lug is rotated greater than 360 degrees.

5. The method of claim 3 including, after setting the liner hanger, releasing the liner hanger by longitudinally raising the mandrel and lug.

6. The method of claim 5 including, recocking said released liner hanger by engaging the downwardly directed surface of the cage with the lug and raising the lug to rotate the cage into a recocking position.

* * * * *